US011661959B2

(12) United States Patent
Takakuwa et al.

(10) Patent No.: US 11,661,959 B2
(45) Date of Patent: May 30, 2023

(54) PRESSURE BOOSTER

(71) Applicant: SMC CORPORATION, Tokyo (JP)

(72) Inventors: Youji Takakuwa, Kitakatsushika-gun (JP); Kengo Monden, Ushiku (JP)

(73) Assignee: SMC CORPORATION, Tokyo (JP)

( * ) Notice: Subject to any disclaimer, the term of this patent is extended or adjusted under 35 U.S.C. 154(b) by 131 days.

(21) Appl. No.: 17/205,285

(22) Filed: Mar. 18, 2021

(65) Prior Publication Data

US 2021/0301838 A1 Sep. 30, 2021

(30) Foreign Application Priority Data

Mar. 25, 2020 (JP) ..... JP2020-053573

(51) Int. Cl.

| | |
|---|---|
| ***F15B 3/00*** | (2006.01) |
| ***F15B 11/032*** | (2006.01) |
| ***F04B 9/129*** | (2006.01) |
| ***F04B 9/133*** | (2006.01) |

(52) U.S. Cl.

CPC ..... *F15B 3/00* (2013.01); *F04B 9/129* (2013.01); *F04B 9/133* (2013.01); *F15B 11/032* (2013.01)

(58) Field of Classification Search

CPC .. F04B 9/129; F04B 9/133; F15B 3/00; F15B 11/032

See application file for complete search history.

(56) References Cited

U.S. PATENT DOCUMENTS

| | | | | |
|---|---|---|---|---|
| 3,143,075 A * | 8/1964 | Giroux | F04B 5/00 417/521 |
| 3,440,967 A | 4/1969 | Pennther | |
| 5,302,090 A * | 4/1994 | Schoo | F04B 9/133 417/399 |
| 7,686,596 B2 * | 3/2010 | Clausen | F15B 3/00 60/560 |

(Continued)

FOREIGN PATENT DOCUMENTS

| | | |
|---|---|---|
| CN | 110307191 A | 10/2019 |
| EP | 2 784 331 A1 | 10/2014 |

(Continued)

OTHER PUBLICATIONS

Extended European Search Report dated Jul. 22, 2021 in corresponding European Patent Application No. 21164025.5, 9 pages.

*Primary Examiner* — Kenneth Bomberg
*Assistant Examiner* — Matthew Wiblin
(74) *Attorney, Agent, or Firm* — Oblon, McClelland, Maier & Neustadt, L.L.P.

(57) ABSTRACT

A pressure booster includes a pressure boosting unit and a bypass unit. The pressure boosting unit includes an input port connected to the side of a fluid supply source and an output port connected to the side of a tank. The pressure boosting unit boosts the pressure of a pressurized fluid supplied to the input port and outputs the pressure-boosted pressurized fluid from the output port. The bypass unit includes a bypass flow path having one end connected to the fluid supply source side and the other end connected to the output port side. The bypass flow path is provided with a bypass check valve configured to block the flow of the pressurized fluid from the output port side to the fluid supply source side.

3 Claims, 10 Drawing Sheets

(56) References Cited

U.S. PATENT DOCUMENTS

| | | | | |
|---|---|---|---|---|
| 2008/0008601 | A1* | 1/2008 | Chausen | F15B 3/00 417/226 |
| 2014/0150421 | A1 | 6/2014 | Sears et al. | |
| 2014/0283512 | A1* | 9/2014 | Buhl | F15B 15/02 60/533 |
| 2015/0322973 | A1* | 11/2015 | Villar | F04B 9/131 91/306 |
| 2016/0090999 | A1* | 3/2016 | Jorgensen | F15B 13/02 60/591 |
| 2020/0063760 | A1* | 2/2020 | Asahara | F15B 13/086 |

FOREIGN PATENT DOCUMENTS

| | | | | |
|---|---|---|---|---|
| JP | 58-101002 | U | 7/1983 | |
| JP | 2000-27801 | A | 1/2000 | |
| JP | 2018-84270 | A | 5/2018 | |
| WO | WO 2013/192148 | A1 | 12/2013 | |
| WO | WO-2019044047 | A1 * | 3/2019 | F15B 21/008 |

* cited by examiner

10

PRESSURE BOOSTER

CROSS-REFERENCE TO RELATED APPLICATION

This application is based upon and claims the benefit of priority from Japanese Patent Application No. 2020-053573 filed on Mar. 25, 2020, the contents of which are incorporated herein by reference.

BACKGROUND OF THE INVENTION

Field of the Invention

The present invention relates to a pressure booster capable of boosting and outputting a pressurized fluid from a fluid supply source.

Description of the Related Art

Conventionally, there has been known a pressure booster that boosts air with a primary pressure, supplied from a compressor and outputs the air with a predetermined secondary pressure.

As an example of such a pressure booster, Japanese Laid-Open Patent Publication No. 2018-084270 discloses a pressure booster having drive cylinders arranged on both sides of a pressure boosting cylinder. As described in this document, the pressurized fluid output from the pressure booster is usually stored in an external tank and used in a manner that it is supplied from the tank to the fluid pressure device.

SUMMARY OF THE INVENTION

However, when filling the tank with air from atmospheric pressure, it takes a long time to fill the tank, especially when the pressure booster is small. Further, since part of the pressurized fluid from the fluid supply source is discharged to the outside while the pressure booster operates, the consumed amount of the pressurized fluid increases as the degree of dependence on the pressure booster is greater.

The present invention has been devised in view of the above circumstances, it is therefore an object of the present invention to provide a pressure booster having high filling efficiency of the tank and low consumption of pressurized fluid.

A pressure booster according to the present invention includes a pressure boosting unit and a bypass unit. The pressure boosting unit includes an input port connected to the side of a fluid supply source and an output port connected to the side of a tank. The pressure boosting unit boosts the pressure of a pressurized fluid supplied to the input port and outputs the pressure-boosted pressurized fluid from the output port. The bypass unit includes a bypass flow path having one end connected to the fluid supply source side and the other end connected to the output port side. The bypass flow path is provided with a bypass check valve configured to block flow of the pressurized fluid from the output port side to the fluid supply source side.

According to the pressure booster, the filling efficiency of the tank is improved, and the pressurized fluid consumption is reduced.

Since the pressure booster according to the present invention includes a path for directly supplying the pressurized fluid from the fluid supply source to the tank, the tank can be filled in a shorter time. In addition, the consumption of the pressurized fluid can be reduced as much as possible.

The above and other objects features and advantages of the present invention will become more apparent from the following description when taken in conjunction with the accompanying drawings in which a preferred embodiment of the present invention is shown by way of illustrative example.

DESCRIPTION OF THE PREFERRED EMBODIMENTS

Hereinafter, a preferable embodiment of a pressure booster according to the present invention will be described in detail with reference to the accompanying drawings.

Figure 1:
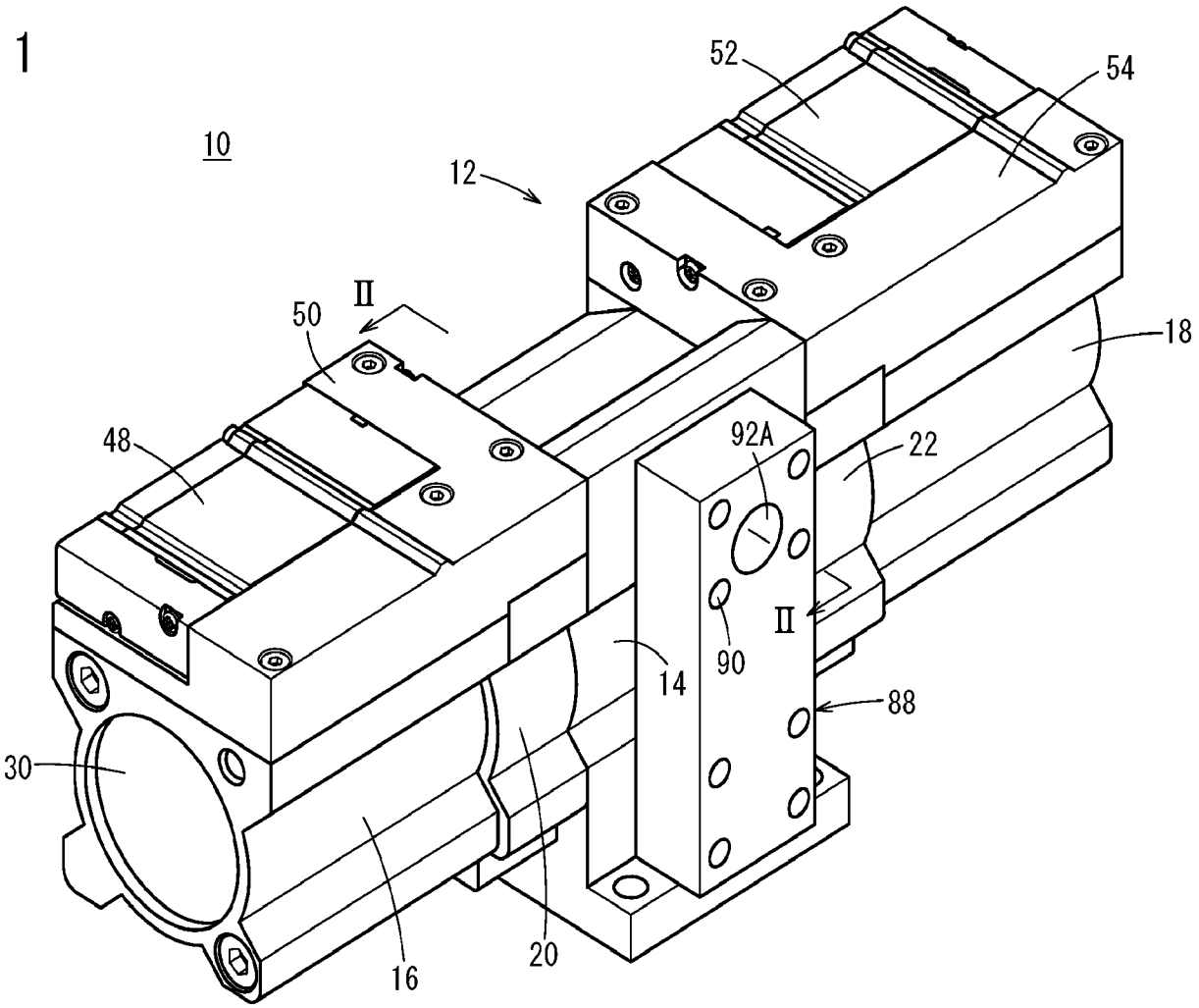
FIG. 1 is an external perspective view of a pressure booster according to an embodiment of the present invention.
Figure 2:
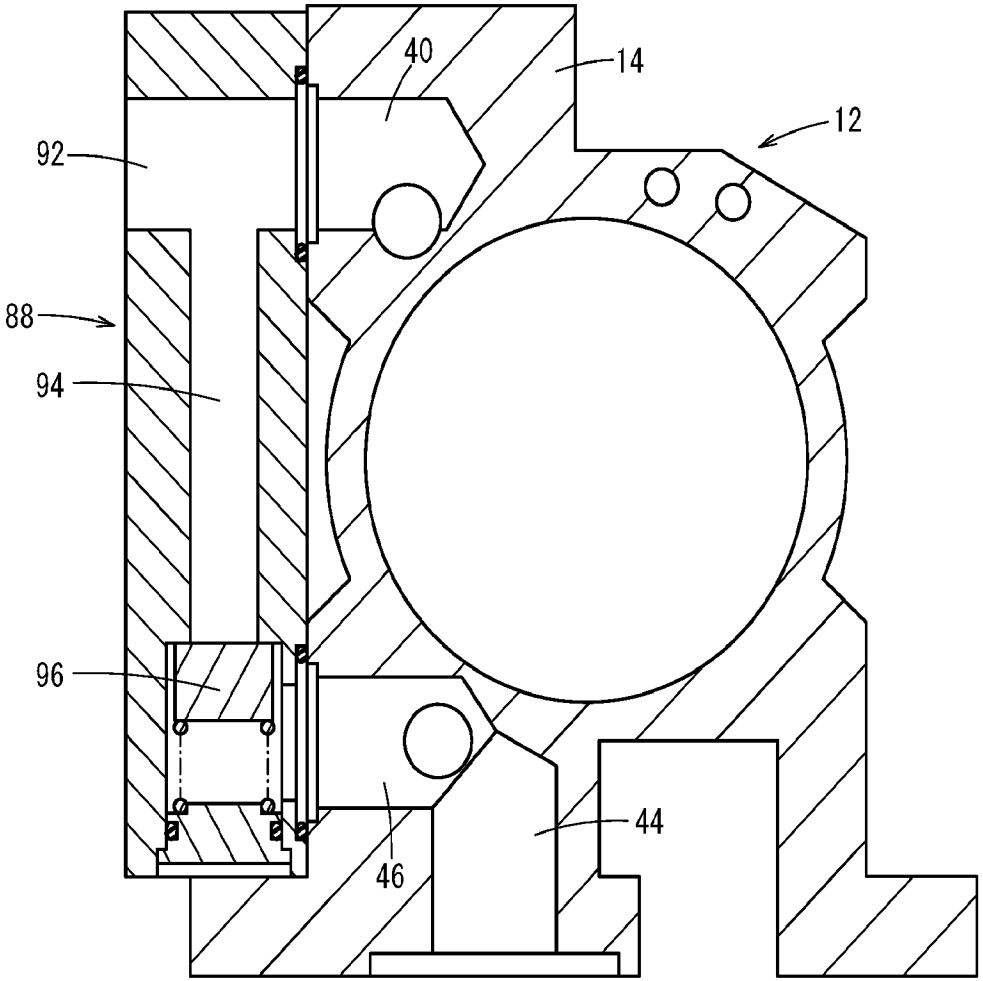
FIG. 2 is a sectional view taken along line II-II of the pressure booster of FIG. 1.

As shown in FIGS. 1 and 2, a pressure booster 10 of the present invention is composed of a pressure boosting unit 12 and a bypass unit 88, and is arranged between a fluid supply source (compressor) and a tank. The fluid supply source and tank are not illustrated.

(Configuration of Pressure Boosting Unit 12)

Figure 3:
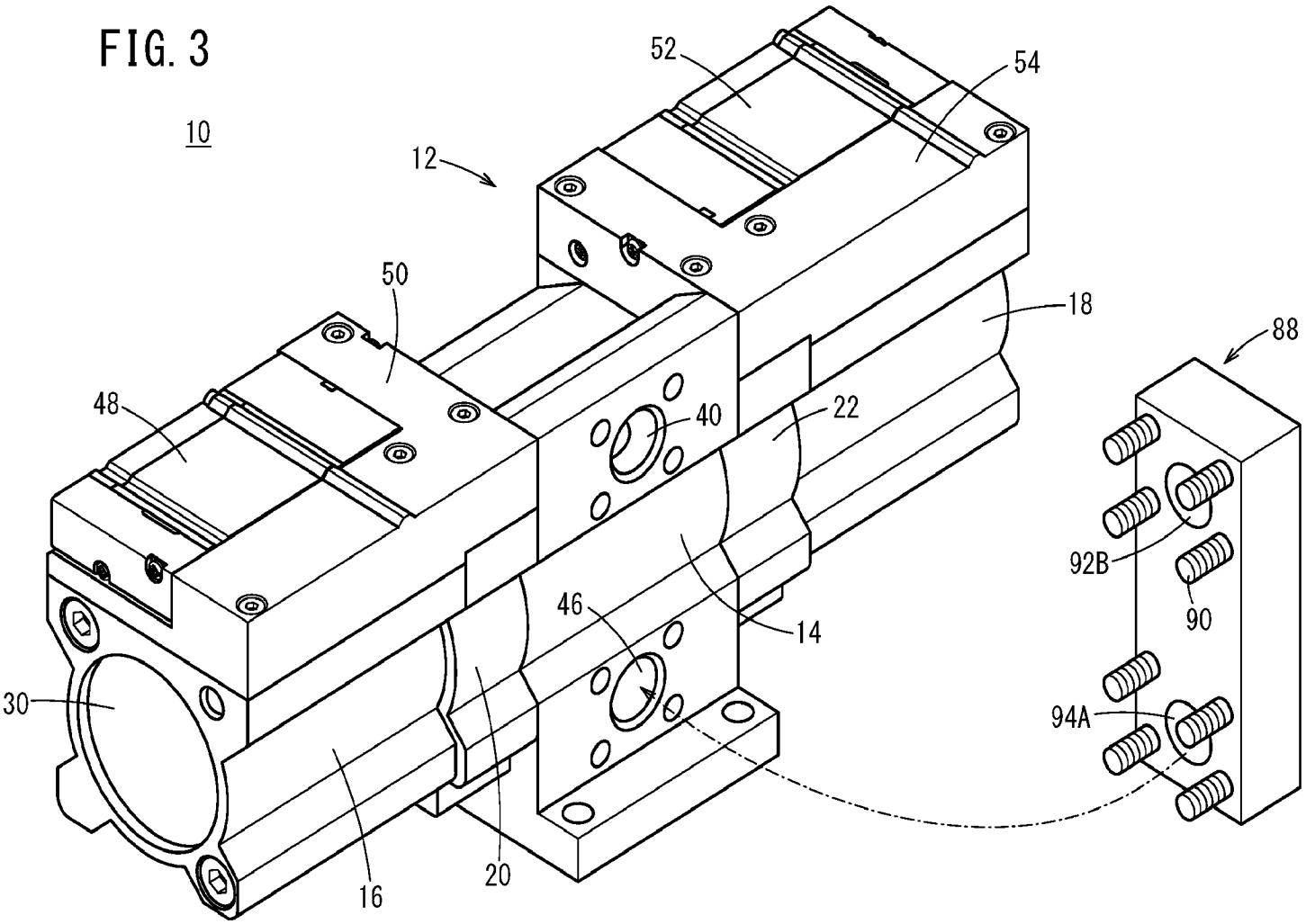
FIG. 3 is a diagram showing a state in which the pressure booster of FIG. 1 is separated into a pressure boosting unit and a bypass unit.

As shown in FIG. 3, the pressure boosting unit 12 has a triple cylinder structure in which a first drive cylinder 16 and a second drive cylinder 18 are joined to a first end side (one end side) and a second end side (the other end side) of the pressure boosting cylinder 14, respectively. A first cover member 20 is interposed between the first drive cylinder 16 and the pressure boosting cylinder 14, and a second cover member 22 is interposed between the pressure boosting cylinder 14 and the second drive cylinder 18.

Figure 6:
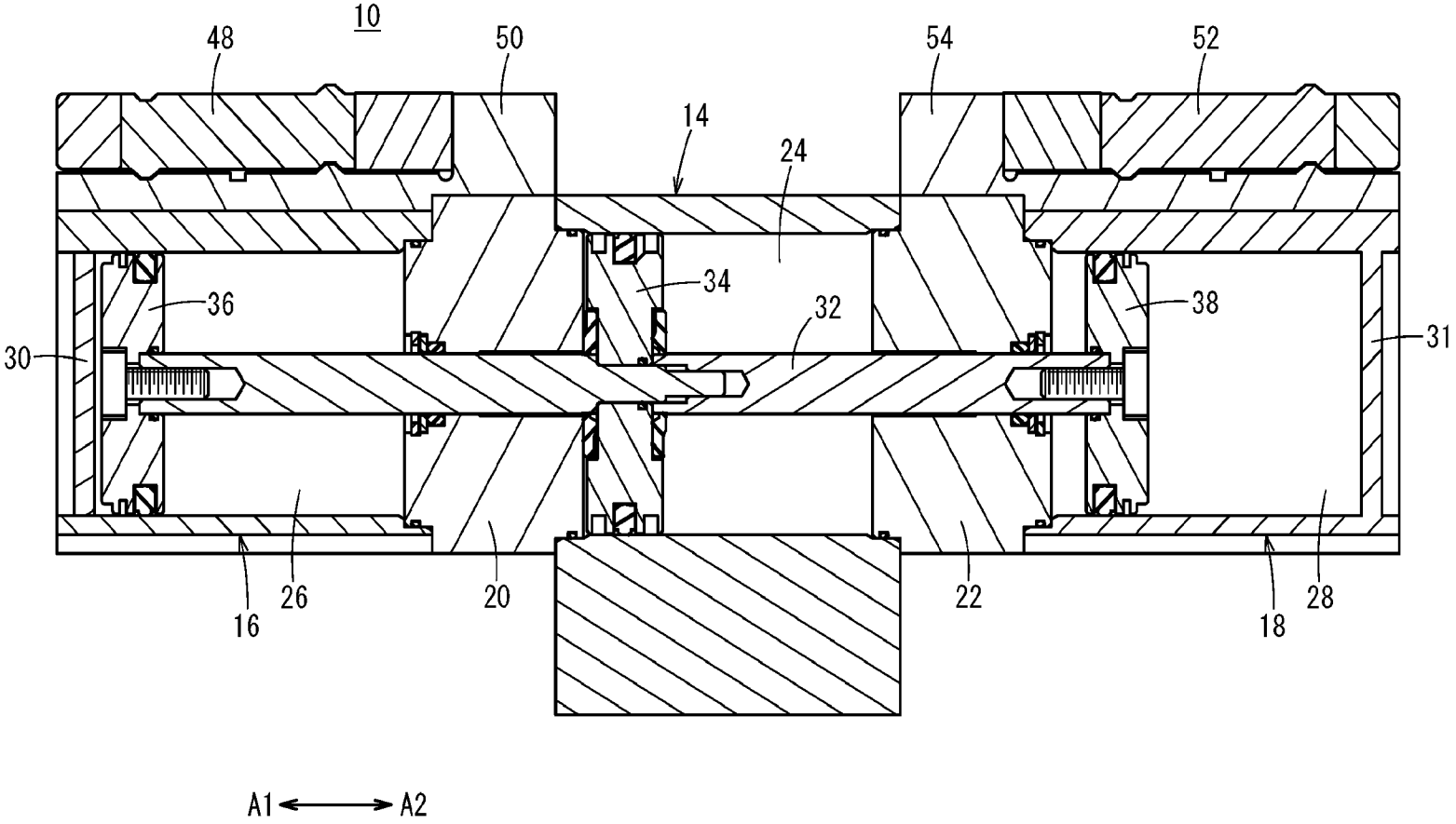
FIG. 6 is a sectional view of the pressure booster of FIG. 1 taken along VI-VI line in FIG. 5.

As shown in FIG. 6, a pressure boosting chamber 24 is formed inside the pressure boosting cylinder 14 while a first drive chamber 26 and a second drive chamber 28 are formed inside the first drive cylinder 16 and the second drive cylinder 18, respectively. In this case, the first drive cylinder 16 has a third cover member 30 fixed at the A1-side end thereof and the first cover member 20 arranged at the A2-side thereof, forming the first drive chamber 26. Further, the second drive cylinder 18 has the second cover member 22 arranged at the A1-side end thereof and a wall 31 arranged at the A2-side for closing, forming the second drive chamber 28.

A piston rod 32 is arranged so as to penetrate the first cover member 20 and the second cover member 22. The first end (one end) of the piston rod 32 extends to the first drive chamber 26, and the second end (the other end) of the piston rod 32 extends to the second drive chamber 28. In the pressure boosting chamber 24, a pressure boosting piston 34 is coupled at the center of the piston rod 32 so that the pressure boosting chamber 24 is partitioned into a first pressure boosting chamber 24*a* on the A1 direction side and a second pressure boosting chamber 24*b* on the A2 direction side (see FIG. 4).

Figure 4:
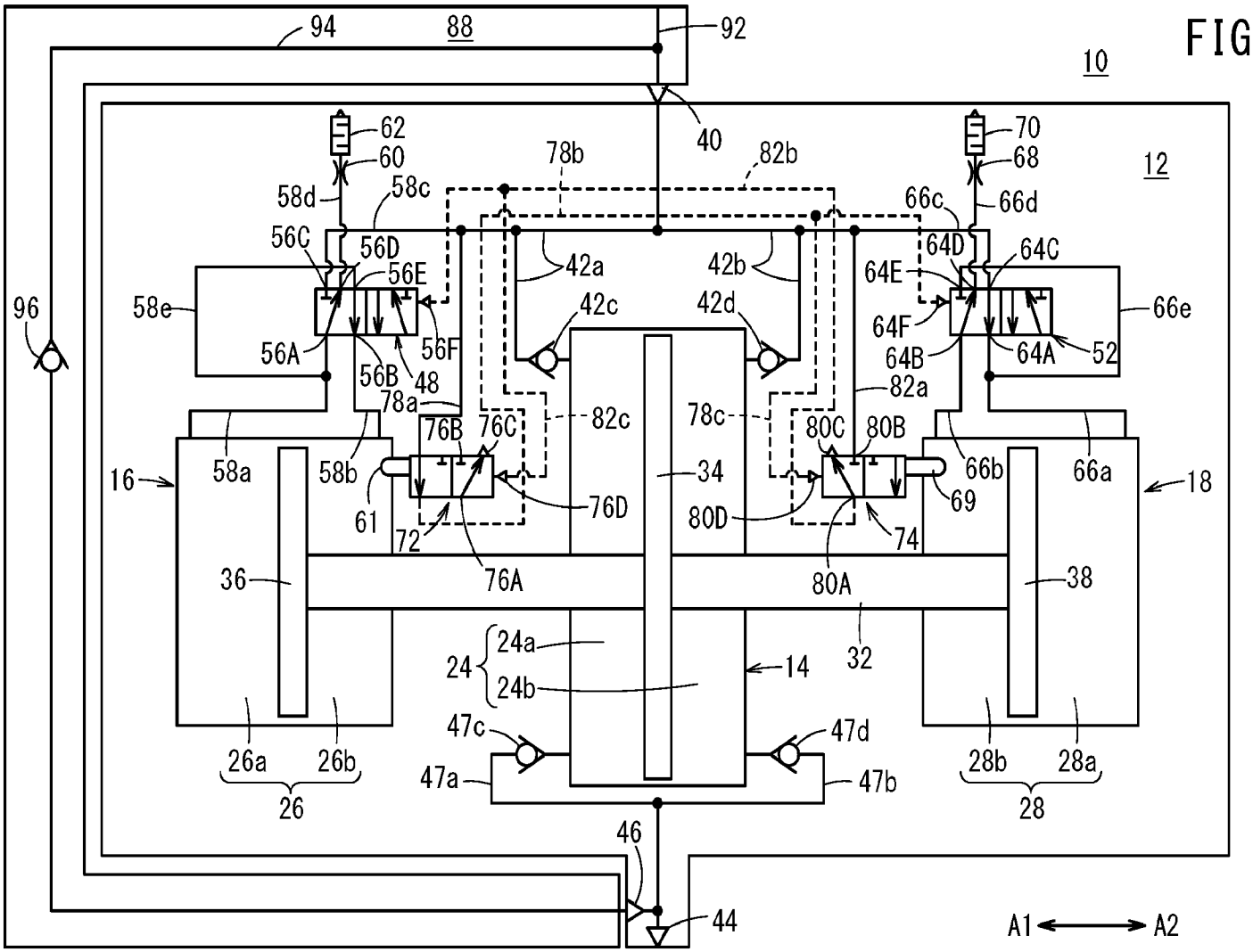
FIG. 4 is an overall schematic diagram of the pressure booster of FIG. 1 using a circuit diagram.
Figure 5:
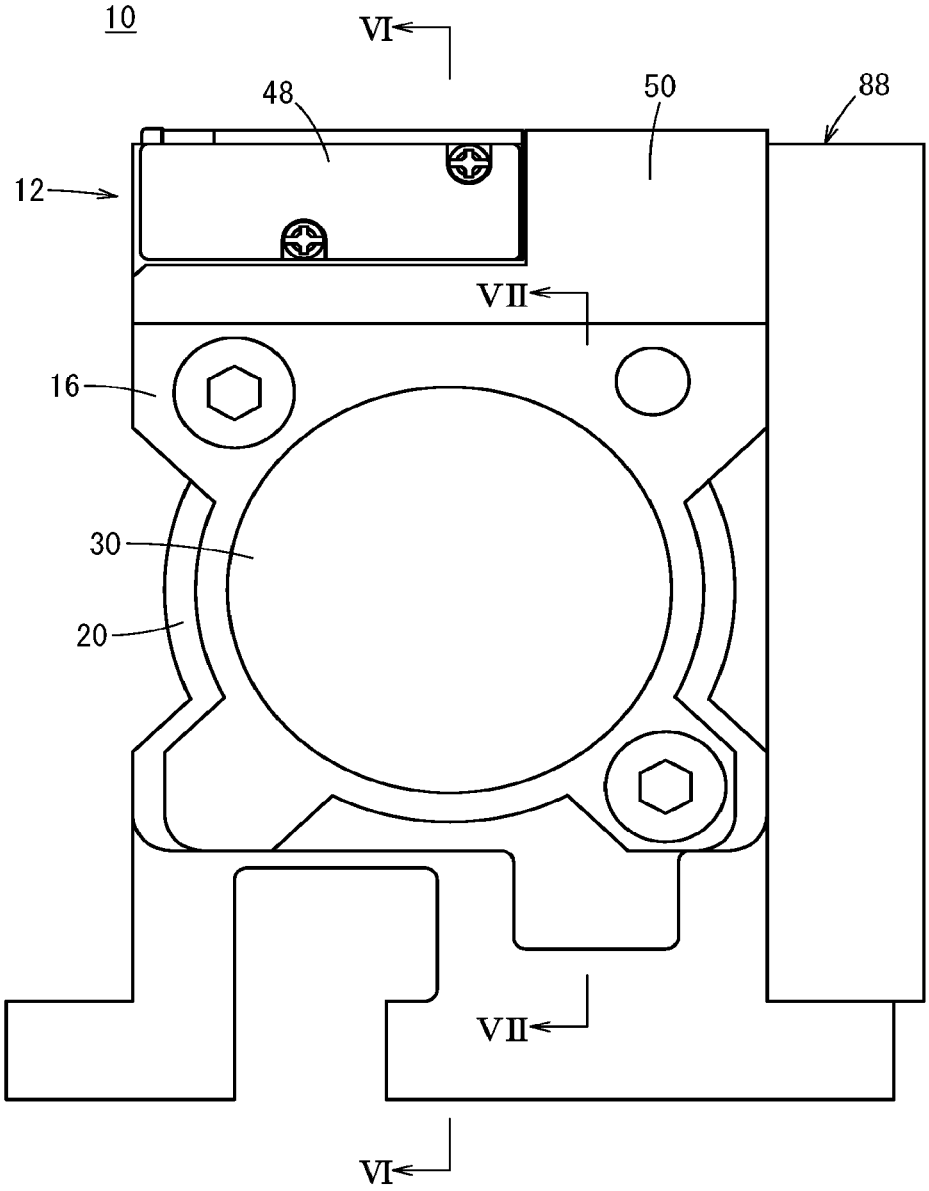
FIG. 5 is a side view of the pressure booster of FIG. 1.

In the first drive chamber 26, a first drive piston 36 is connected at the first end of the piston rod 32 so that the first drive chamber 26 is partitioned into a pressurizing chamber 26*a* on the A1 direction side and a back pressure chamber 26*b* on the A2 direction side (see FIG. 4). In the second drive chamber 28, a second drive piston 38 is connected to the second end of the piston rod 32 so that the second drive chamber 28 is partitioned into a pressurizing chamber 28*a* on the A2 direction side and a back pressure chamber 28*b* on the A1 direction side (See FIG. 4). The pressure boosting piston 34, the first drive piston 36, and the second drive piston 38 are integrally connected by the piston rod 32.

As shown in FIG. 3, the pressure boosting cylinder 14 has an input port 40 to which a pressurized fluid (compressed air) is supplied from the fluid supply source via the bypass unit 88. The input port 40 is opened in the upper part of the front face of the pressure boosting cylinder 14.

Figure 7:
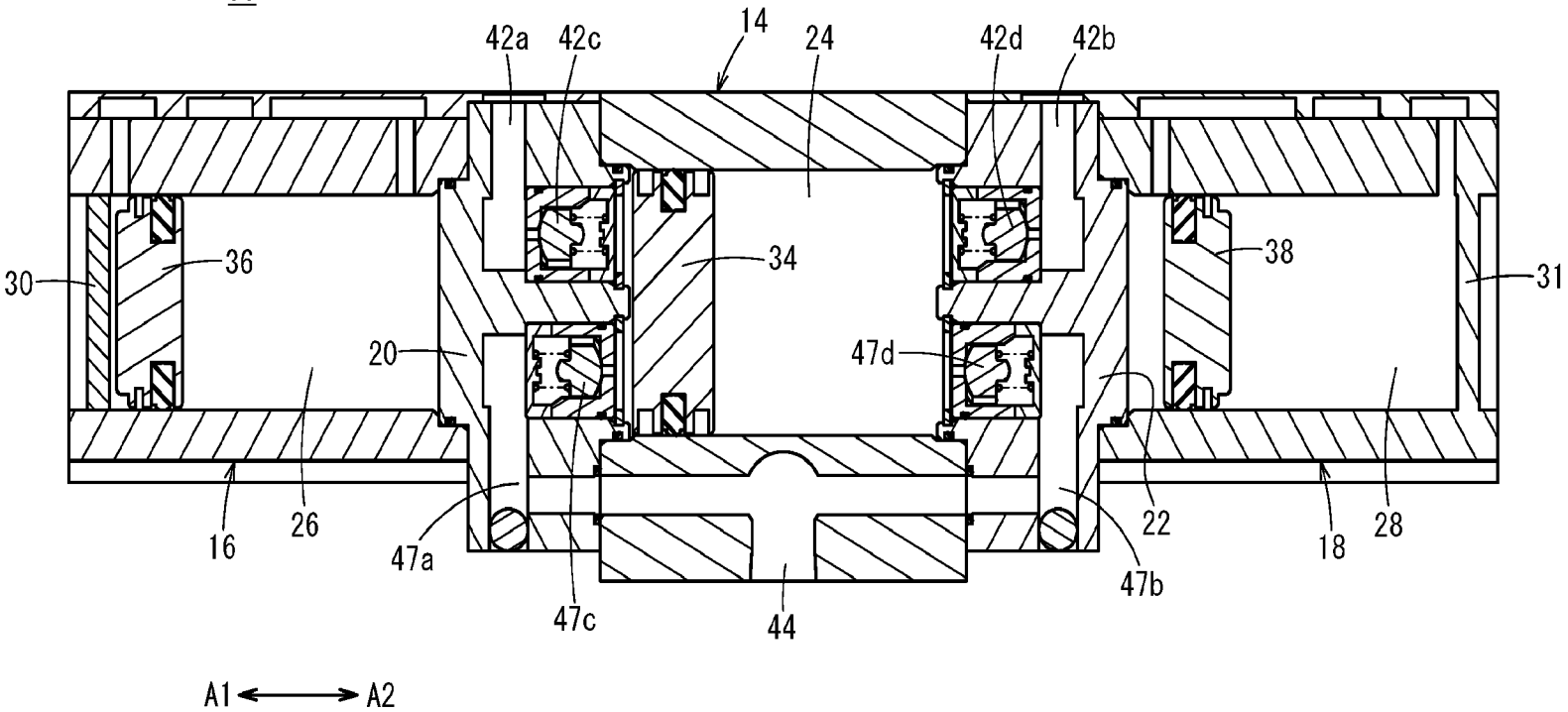
FIG. 7 is a sectional view of the pressure booster of FIG. 1 taken along line VII-VII of FIG. 5.

As shown in FIGS. 4 and 7, the first cover member 20 and the second cover member 22 have, installed thereinside, a fluid supply mechanism which introduces the pressurized fluid supplied to the pressure boosting unit 12 into the first pressure boosting chamber 24*a* and the second pressure boosting chamber 24*b*. This fluid supply mechanism has a first supply flow path 42*a* that connects the input port 40 and the first pressure boosting chamber 24*a*, and a second supply flow path 42*b* that connects the input port 40 and the second pressure boosting chamber 24*b*.

The first supply flow path 42*a* includes a first supply check valve 42*c* that blocks a fluid flow in the direction from the first pressure boosting chamber 24*a* toward the input port 40. The second supply flow path 42*b* includes a second supply check valve 42*d* that blocks a fluid flow in the direction from the second pressure boosting chamber 24*b* toward the input port 40.

As shown in FIGS. 2 and 3, the pressure boosting cylinder 14 is provided with an output port 44 that outputs the pressure-boosted pressurized fluid toward the tank, and a merging port 46 that connects the output port 44 to the bypass unit 88. The output port 44 is opened on the bottom face of the pressure boosting cylinder 14, and the merging port 46 is opened in the lower part on the front face of the pressure boosting cylinder 14.

As shown in FIGS. 4 and 7, the first cover member 20 and the second cover member 22 contain therein a fluid output mechanism which outputs the fluid that has been pressure-boosted in the first pressure boosting chamber 24*a* or the second pressure boosting chamber 24*b*, from the output port 44. This fluid output mechanism has a first output flow path 47*a* that connects the first pressure boosting chamber 24*a* and the output port 44, and a second output flow path 47*b* that connects the second pressure boosting chamber 24*b* and the output port 44.

The first output flow path 47*a* is provided with a first output check valve 47*c* that blocks a fluid flow in the direction from the output port 44 toward the first pressure boosting chamber 24*a*. The second output flow path 47*b* is provided with a second output check valve 47*d* that blocks a fluid flow from the output port 44 toward the second pressure boosting chamber 24*b*.

As shown in FIG. 3, a first housing 50 provided with a first operating valve 48 is disposed on the top of the first drive cylinder 16, and a second housing 54 provided with a second operating valve 52 is disposed on the top of the second drive cylinder 18.

As shown in FIG. 4, the first operating valve 48 has a first port 56A, a second port 56B, a third port 56C, a fourth port 56D, and a fifth port 56E, and is configured to switch between a first position for driving the first drive piston 36 and a second position for allowing the first drive piston 36 to be driven by movement of the second drive piston 38.

The first port 56A is connected to the pressurizing chamber 26*a* of the first drive cylinder 16 by a flow path 58*a*. The second port 56B is connected to the back pressure chamber 26*b* of the first drive cylinder 16 by a flow path 58*b*. The third port 56C is connected to the first supply flow path 42*a* by a flow path 58*c*. The fourth port 56D is connected to a first silencer 62 having an exhaust port by a flow path 58*d*. The fifth port 56E is connected to a midway point of the flow path 58*a* by a flow path 58*e*. A first fixed orifice 60 is interposed in the flow path 58*d*.

When the first operating valve 48 is in the first position, the first port 56A and the third port 56C communicate with each other, and the second port 56B and the fourth port 56D communicate with each other. As a result, the pressurized fluid from the input port 40 is supplied to the pressurizing chamber 26*a* through the flow path 58*c* and the flow path 58*a*, and the fluid in the back pressure chamber 26*b* flows through the flow path 58*b* and the flow path 58*d* and is then discharged via the first fixed orifice 60 and the first silencer 62.

When the first operating valve 48 is in the second position, the first port 56A and the fourth port 56D communicate with each other, and the second port 56B and the fifth port 56E communicate with each other. As a result, part of the fluid in the pressurizing chamber 26*a* is collected into the back pressure chamber 26*b* through the flow path 58*a*, the flow path 58*e* and the flow path 58*b*, and the remaining part flows through the flow path 58*d* and is then discharged via the first fixed orifice 60 and the first silencer 62.

The first operating valve 48 further includes a pilot port 56F for introducing a pilot pressure from a second pilot valve 74, which will be described later. The first operating valve 48 is in the first position when the pressurized fluid is supplied to the pilot port 56F, and it is in the second position when the pressurized fluid is not supplied to the pilot port 56F.

The second operating valve 52 has first to fifth ports 64A to 64E, and is configured to be able to switch between a first position for driving the second drive piston 38 and a second position for allowing the second drive piston 38 to be driven by movement of the first drive piston 36.

The first port 64A is connected to the pressurizing chamber 28*a* of the second drive cylinder 18 by a flow path 66*a*. The second port 64B is connected to the back pressure chamber 28*b* of the second drive cylinder 18 by a flow path 66*b*. The third port 64C is connected to the second supply flow path 42*b* by a flow path 66*c*. The fourth port 64D is connected to a second silencer 70 having an exhaust port by a flow path 66*d*. The fifth port 64E is connected to a midway point of the flow path 66*a* by a flow path 66*e*. A second fixed orifice 68 is interposed in the flow path 66*d*.

When the second operating valve 52 is in the first position, the first port 64A and the third port 64C communicate with each other, and the second port 64B and the fourth port 64D communicate with each other. As a result, the pressurized fluid from the input port 40 is supplied to the pressurizing chamber 28*a* through the flow path 66*c* and the flow path 66*a*, and the fluid in the back pressure chamber 28*b* flows through the flow path 66*b* and the flow path 66*d* and is then discharged via the second fixed orifice 68 and the second silencer 70.

When the second operating valve 52 is in the second position, the first port 64A and the fourth port 64D communicate with each other, and the second port 64B and the fifth port 64E communicate with each other. As a result, part of the fluid in the pressurizing chamber 28*a* is collected into the back pressure chamber 28*b* through the flow path 66*a*, the flow path 66*e* and the flow path 66*b*, and the remaining part flows through the flow path 66*d* and is then discharged via the second fixed orifice 68 and the second silencer 70.

The second operating valve 52 further includes a pilot port 64F for introducing a pilot pressure from a first pilot valve 72, which will be described later. The second operating valve 52 is in the first position when the pressurized fluid is supplied to the pilot port 64F, and it is in the second position when the pressurized fluid is not supplied to the pilot port 64F.

The first pilot valve 72 is disposed inside the first cover member 20, and the second pilot valve 74 is disposed inside the second cover member 22. The first pilot valve 72 has first to fourth ports 76A to 76D, and is configured to be able to switch between a first position for generating a pilot pressure for the second operating valve 52 and a second position for eliminating the pilot pressure.

The first port 76A is connected to the pilot port 64F of the second operating valve 52 by a first pilot flow path 78*b*. The second port 76B is connected to the first supply flow path 42*a* by a flow path 78*a*. The third port 76C forms an exhaust port. The fourth port 76D is connected to an after-mentioned first port 80A of the second pilot valve 74 by a branch flow path 82*c* and a second pilot flow path 82*b*, which will be described later. Further, a branch flow path 78*c* connecting to a fourth port 80D of the second pilot valve 74, which will be described later, is provided so as to branch off from the first pilot flow path 78*b*.

When the first pilot valve 72 is in the first position, the first port 76A and the second port 76B communicate with each other. As a result, the pressurized fluid from the input port 40 is supplied to the pilot port 64F of the second operating valve 52 through the flow path 78*a* and the first pilot flow path 78*b*, and is also supplied to the fourth port 80D of the second pilot valve 74, which will be described later, through the branch flow path 78*c* branching from the first pilot flow path 78*b*.

When the first pilot valve 72 is in the second position, the first port 76A and the third port 76C communicate with each other. As a result, the pressurized fluid that has been supplied to the pilot port 64F of the second operating valve 52 is discharged through the first pilot flow path 78*b*, and the pressurized fluid that has been supplied to the fourth port 80D of the second pilot valve 74 is discharged through the branch flow path 78*c* and the first pilot flow path 78*b*.

The second pilot valve 74 has first to fourth ports 80A to 80D, and is configured to be able to switch between a first position for generating a pilot pressure for the first operating valve 48 and a second position for eliminating the pilot pressure.

The first port 80A is connected to the pilot port 56F of the first operating valve 48 by the second pilot flow path 82*b*. The second port 80B is connected to the second supply flow path 42*b* by a flow path 82*a*. The third port 80C forms an exhaust port. The fourth port 80D is connected to the first port 76A of the first pilot valve 72 by the branch flow path 78*c* and the first pilot flow path 78*b*. Further, a branch flow path 82*c* connecting to the fourth port 76D of the first pilot valve 72 is provided so as to branch off from the second pilot flow path 82*b*.

When the second pilot valve 74 is in the first position, the first port 80A and the second port 80B communicate with each other. As a result, the pressurized fluid from the input port 40 is supplied to the pilot port 56F of the first operating valve 48 through the flow path 82*a* and the second pilot flow path 82*b*, and is also supplied to the fourth port 76D of the first pilot valve 72 through the branch flow path 82*c* branching from the second pilot flow path 82*b*.

When the second pilot valve 74 is in the second position, the first port 80A and the third port 80C communicate with each other. As a result, the pressurized fluid that has been supplied to the pilot port 56F of the first operating valve 48 is discharged through the second pilot flow path 82*b*, and the pressurized fluid that has been supplied to the fourth port 76D of the first pilot valve 72 is discharged through the branch flow path 82*c* and the second pilot flow path 82*b*.

Figure 8:
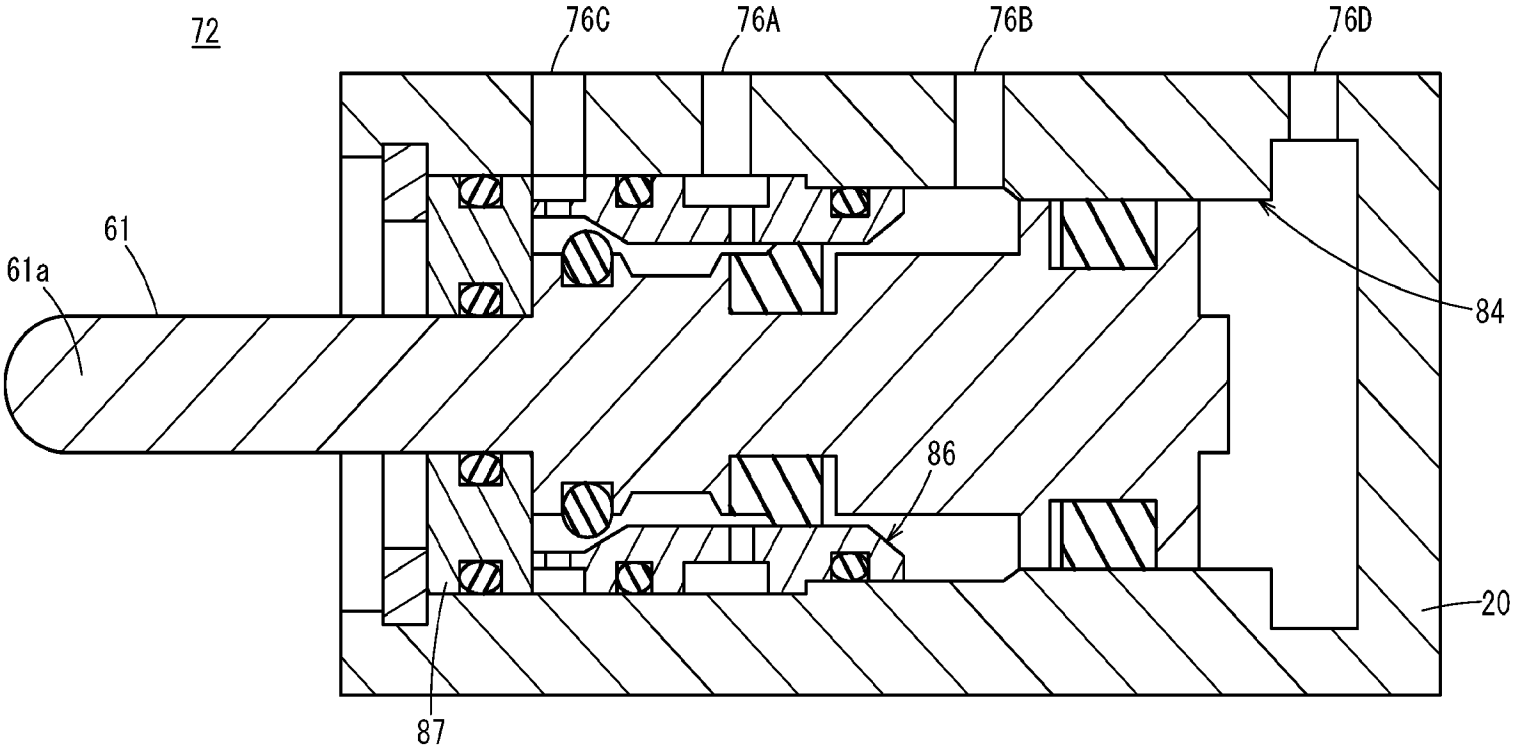
FIG. 8 is a diagram showing a structure of a first pilot valve in the pressure booster of FIG. 1.
Figure 9:
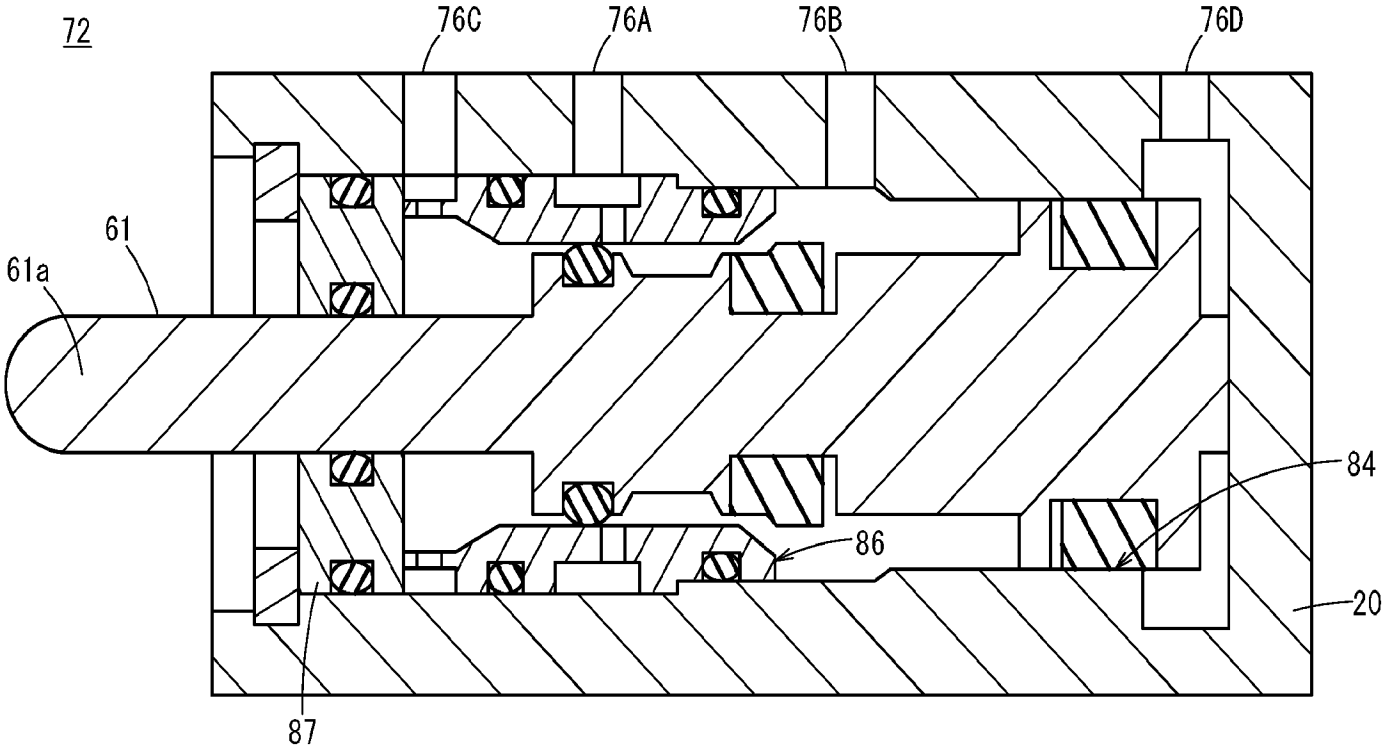
FIG. 9 is a diagram when the first pilot valve of FIG. 8 is in a different operating position.

Next, the specific structure of the first pilot valve 72 will be described with reference to FIGS. 8 and 9. The second pilot valve 74 has the same structure. For convenience, a reference numeral 61 is allotted to the knock pin of the first pilot valve 72 while a reference numeral 69 is allotted to the knock pin of the second pilot valve 74 in order to show the two in a distinguishing manner.

The first pilot valve 72 includes a valve seat 86, a valve seat retainer 87, and a knock pin 61, accommodated in a valve housing hole 84 formed in the first cover member 20. The knock pin 61 has a tip portion 61*a* that projects into the back pressure chamber 26*b* of the first drive cylinder 16, and is configured to be capable of sliding between two positions, i.e., an abutment position where the knock pin abuts against the bottom face of the valve housing hole 84 (see FIG. 9) and another abutment position where the knock pin abuts against the end face of the valve seat retainer 87 (see FIG. 8). When the projecting length of the knock pin 61 is larger, the first port 76A communicates with the third port 76C, whereas when the projecting length of the knock pin 61 is smaller, the first port 76A communicates with the second port 76B.

When the pressurized fluid is supplied to the fourth port 76D, the knock pin 61 is urged in a direction in which the projecting length increases. This is because the area of the knock pin 61 on which the fluid pressure in the fourth port 76D acts to increase the projecting length of the knock pin 61 is larger than the area of the knock pin 61 on which the fluid pressure in the second port 76B acts to decrease the projecting length of the knock pin 61.

On the other hand, when the pressurized fluid is not supplied to the fourth port 76D, the knock pin 61 is urged in a direction in which the projecting length decreases. This is because the fluid pressure in the fourth port 76D which acts to increase the projecting length of the knock pin 61 disappears, whereas the fluid pressure in the second port 76B which acts to decrease the projecting length of the knock pin 61 continues to act thereon.

(Configuration of Bypass Unit 88)

As shown in FIG. 3, the rectangular parallelepiped bypass unit 88 is attached to the front face of the pressure boosting cylinder 14 having the openings of the input port 40 and the merging port 46, by using multiple bolts 90. As shown in FIGS. 2 and 4, a main flow path 92 and a bypass flow path 94 are formed inside the bypass unit 88.

The main flow path 92 is formed in the upper part of the bypass unit 88 so as to penetrate from the front face of the bypass unit 88 to the rear face which is in contact with the pressure boosting cylinder 14. The main flow path 92 has an inlet-side end portion 92A (see FIG. 1) that opens in the front face of the bypass unit 88 and which is connected to the fluid supply source via an unillustrated tube. The main flow path 92 also has an outlet-side end portion 92B that opens in the rear face of the bypass unit 88 and which is connected to the input port 40 of the pressure boosting cylinder 14.

The bypass flow path 94 branches off from a point of the main flow path 92 and extends downward inside the bypass unit 88, and its outlet-side end portion 94A opens in the rear face of the bypass unit 88 and is connected to the merging port 46 of the pressure boosting cylinder 14. The bypass flow path 94 is provided with a bypass check valve 96 that allows the flow of pressurized fluid from the fluid supply source to the merging port 46 and blocks the flow of pressurized fluid from the merging port 46 toward the fluid supply source.

Routes for outputting the pressurized fluid from the fluid supply source toward the tank include the following two routes. In one route, the pressurized fluid flows through the main flow path 92 of the bypass unit 88 and the bypass flow path 94 with the bypass check valve 96 interposed therein, and then reaches the output port 44 via the merging port 46 of the pressure boosting unit 12 (which will be referred to hereinbelow as "first route"). In the other route, the pressurized fluid flows through the main flow path 92 of the bypass unit 88, thereafter enters the pressure boosting unit 12 through the input port 40, thereafter flows through the first supply flow path 42*a* or the second supply flow path 42*b*, the first pressure boosting chamber 24*a* or the second pressure boosting chamber 24*b*, and the first output flow path 47*a* or the second output flow path 47*b*, and then reaches the output port 44 (which will be referred to hereinbelow as "second route").

The configuration of the pressure booster 10 according to the embodiment of the present invention has been described above, and its operation will now be described next. The initial state is assumed such that, as shown in FIG. 4, the first operating valve 48 is switched in the second position, the second operating valve 52 is switched in the first position, and the pressure boosting piston 34 is located around the center of the pressure boosting chamber 24. It is also assumed that, at this time, the pressure in the tank is atmospheric pressure.

In this initial state, the pressurized fluid from the fluid supply source is supplied to the inlet-side end portion 92A of the main flow path 92 in the bypass unit 88. Since the output port 44 is connected to a tank of a low pressure, the pressure at the merging port 46 is lower than the pressure at the main flow path 92. Therefore, part of the pressurized fluid from the fluid supply source flows through the first route and is output from the output port 44 toward the tank. Further, the other part of the pressurized fluid from the fluid supply source flows through the second route, is pressure-boosted by the pressure boosting unit 12, and is output from the output port 44 toward the tank. The pressure boosting action in the pressure boosting unit 12 will be described later.

In the above way, when the pressure at the merging port 46 is lower than the pressure at the main flow path 92, the pressurized fluid from the fluid supply source is not only directly supplied to the tank through the bypass flow path 94 but also supplied to the tank by being pressure-boosted through the pressure boosting unit 12. Thus, the pressure in the tank can be increased quickly.

As the tank proceeds to be charged and the pressure at the merging port 46 exceeds the pressure at the main flow path 92, the bypass flow path 94 is closed by the action of the bypass check valve 96. Therefore, only the pressurized fluid that has flowed through the second route and thereby pressure-boosted is output from the output port 44 toward the tank. As a result, the pressure of the tank can be raised to a predetermined pressure higher than the supply pressure from the fluid supply source.

(Pressure Boosting Action in Pressure Boosting Unit 12)

As a pressurized fluid is supplied to the input port 40 of the pressure boosting unit 12, the pressurized fluid flows into the first supply flow path 42*a* and the second supply flow path 42*b*, and enters the first pressure boosting chamber 24*a* and the second pressure boosting chamber 24*b* of the pressure boosting cylinder 14 via the first supply check valve 42*c* and the second supply check valve 42*d*, respectively.

Part of the pressurized fluid supplied from the input port 40 flows through the flow path 66*c*, the second operating valve 52 placed in the first position, and the flow path 66*a*, and is then supplied to the pressurizing chamber 28*a* of the second drive cylinder 18. As a result, the second drive piston 38 is driven in the A1 direction, and the pressure boosting piston 34 integrally connected to the second drive piston 38 slides, so that the pressure of the pressurized fluid in the first pressure boosting chamber 24*a* of the pressure boosting cylinder 14 is increased. The thus pressure-boosted pressurized fluid is led to the output port 44 through the first output check valve 47*c* and the first output flow path 47*a*, and is then output therefrom.

On the other hand, when the first drive piston 36 integrally connected to the second drive piston 38 slides, the volume of the pressurizing chamber 26*a* of the first drive cylinder 16 becomes smaller. Since the first operating valve 48 is in the second position, part of the pressurized fluid in the pressurizing chamber 26*a* is collected into the back pressure chamber 26*b* through the flow path 58*a*, the flow path 58*e* and the flow path 58*b*, and the remaining part is discharged through the flow path 58*d*.

As described above, in the process in which the pressure boosting piston 34 moves from the initial position by a predetermined distance in the A1 direction, the first pilot valve 72 is in the first position, so that the pressurized fluid from the input port 40 flows through the first pilot valve 72 and is supplied to the fourth port 80D of the second pilot valve 74. On the other hand, the second pilot valve 74 is in the second position, and thus no pressurized fluid is supplied to the fourth port 76D of the first pilot valve 72. Therefore, in the first pilot valve 72, the knock pin 61 is urged in the direction so as to reduce the projecting length, and the first pilot valve 72 is stably held in the first position. In the second pilot valve 74, the knock pin 69 is urged in the direction so as to increase the projecting length, and the second pilot valve 74 is stably held in the second position.

Then, the second drive piston 38 comes into contact with the knock pin 69 of the second pilot valve 74 as the pressure boosting piston 34 moves in the A1 direction and to the vicinity of the stroke end. The knock pin 69 is pushed and displaced by the second drive piston 38, leading to communication between the first port 80A and the second port 80B of the second pilot valve 74. Then, the pressurized fluid from the input port 40 is supplied to the pilot port 56F of the first operating valve 48 through the second pilot flow path 82*b*, and is also supplied to the fourth port 76D of the first pilot valve 72 through the branch flow path 82*c*. As a result, the first operating valve 48 is switched to the first position, and the first pilot valve 72 is switched to the second position.

When the first pilot valve 72 has been switched to the second position, the pressurized fluid that has been supplied to the pilot port 64F of the second operating valve 52 flows through the first pilot flow path 78*b* and is discharged from the third port 76C of the first pilot valve 72. As a result, the second operating valve 52 is switched to the second position.

Additionally, when the first pilot valve 72 has been switched to the second position, the pressurized fluid that has been supplied to the fourth port 80D of the second pilot valve 74 flows through the branch flow path 78*c* and the first pilot flow path 78*b* and is discharged from the third port 76C of the first pilot valve 72. Therefore, in the second pilot valve 74, the fluid pressure acts in the direction in which the projecting length of the knock pin 69 decreases. In this way, the knock pin 69 is displaced, by the pushing of the second drive piston 38, to thereby establish communication between the first port 80A and the second port 80B of the second pilot valve 74, and the thus-displaced knock pin 69 further receives the fluid pressure and is held in a position where the knock pin 69 abuts against the bottom face of the valve housing hole 84. That is, the second pilot valve 74 is stably held in the first position.

Next, part of the pressurized fluid supplied from the input port 40 flows through the flow path 58*c*, the first operating valve 48 in the first position, and the flow path 58*a*, and is then supplied to the pressurizing chamber 26*a* of the first drive cylinder 16. The pressurized fluid supplied to this pressurizing chamber 26*a* drives the first drive piston 36 in the A2 direction. As a result, the pressure boosting piston 34 integrally connected to the first drive piston 36 slides, so that the pressure of the pressurized fluid in the second pressure boosting chamber 24*b* of the pressure boosting cylinder 14 is increased. The thus pressure-boosted pressurized fluid is led to the output port 44 through the second output flow path 47*b* and the second output check valve 47*d* and then output therefrom.

On the other hand, when the second drive piston 38 integrally connected to the first drive piston 36 slides, the volume of the pressurizing chamber 28*a* of the second drive cylinder 18 becomes smaller. Since the second operating valve 52 is in the second position, part of the pressurized fluid in the pressurizing chamber 28*a* is collected into the back pressure chamber 28*b* through the flow path 66*a*, the flow path 66*e*, and a flow path 66*b*, and the remaining part is discharged through the flow path 66*d*.

Then, the first drive piston 36 comes into contact with the knock pin 61 of the first pilot valve 72 as the pressure boosting piston 34 moves in the A2 direction and to the vicinity of the stroke end. The knock pin 61 is pressed and displaced by the first drive piston 36, leading to communication between the first port 76A and the second port 76B of the first pilot valve 72. Then, the pressurized fluid from the input port 40 is supplied to the pilot port 64F of the second operating valve 52 through the first pilot flow path 78*b*, and is also supplied to the fourth port 80D of the second pilot valve 74 through the branch flow path 78*c*. As a result, the second operating valve 52 is switched to the first position, and the second pilot valve 74 is switched to the second position.

When the second pilot valve 74 has been switched to the second position, the pressurized fluid that has been supplied to the pilot port 56F of the first operating valve 48 flows through the second pilot flow path 82*b* and is discharged from the third port 80C of the second pilot valve 74. As a result, the first operating valve 48 is switched to the second position.

Additionally, when the second pilot valve 74 has been switched to the second position, the pressurized fluid that has been supplied to the fourth port 76D of the first pilot valve 72 flows through the branch flow path 82*c* and the second pilot flow path 82*b* and is discharged from the third port 80C of the second pilot valve 74. Therefore, in the first pilot valve 72, the fluid pressure acts in the direction so as to reduce the projecting length of the knock pin 61. In this way, the knock pin 61 is displaced, by the pushing of the first drive piston 36, to thereby establish communication between the first port 76A and the second port 76B of the first pilot valve 72, and the thus-displaced knock pin 61 further receives the fluid pressure and is held in a position where the knock pin 61 abuts on the bottom face of the valve housing hole 84. That is, the first pilot valve 72 is stably held in the first position. Thereafter, the pressure boosting piston 34 repeats the same reciprocating motion, so that the pressure-boosted pressurized fluid is continuously output from the output port 44.

Figure 10:
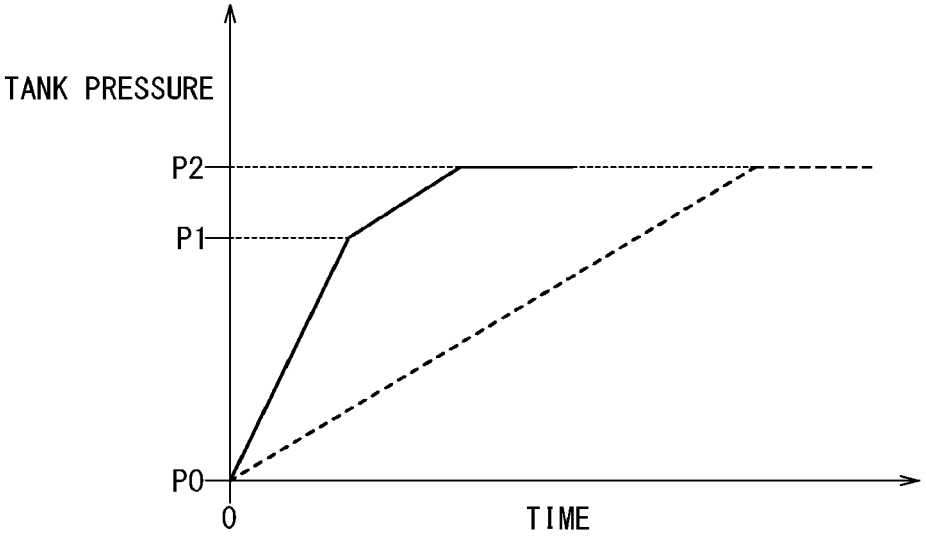
FIG. 10 is a diagram showing the relationship between the pressure of the tank and elapsed time in a case that the tank is charged with air from atmospheric pressure.

FIG. 10 is a diagram showing the relationship between the elapsed time from the start of filling and the pressure of the tank (pressure at the output port 44), when the tank is charged from atmospheric pressure. The solid line shows a case where the bypass unit 88 is installed as in the pressure booster 10 of the present embodiment, and the dotted line shows a case where the bypass unit 88 is not installed. P0, P1 and P2 represent the atmospheric pressure, the pressure of the fluid supplied from the pressurized fluid supply source, and the target pressure of the tank, respectively. As can be understood from the figure, provision of the bypass unit 88 makes it possible to shorten the time required to raise the pressure of the tank to P1.

According to the pressure booster 10 according to the present embodiment, since the first route for directly supplying the pressurized fluid from the fluid supply source to the tank is included, the filling time of the tank can be shortened as much as possible, and the consumption of pressurized fluid can be reduced as much as possible.

Further, since the input port 40 is connected to the fluid supply source via the main flow path 92 provided in the bypass unit 88 and the bypass flow path 94 branches from the main flow path 92, the connection between the pressure boosting unit 12 and the fluid supply source and the connection between the bypass unit 88 and the fluid supply source can be completed with a single tube, thus simplifying the routing of tubing or piping.

Further, since the bypass flow path 94 is connected to the output port 44 via the merging port 46 provided in the pressure boosting unit 12, the connection between the pressure boosting unit 12 and the tank and the connection between the bypass unit 88 and the tank can be completed with a single tube, thus simplifying routing of tubing or piping.

Further, since the bypass unit 88 is attached to the front face of the pressure boosting cylinder 14 in which the input port 40 and the merging port 46 are opened, the entire device can be made compact.

It goes without saying that the pressure booster according to the present invention is not limited to the above-described embodiment, and may take various configurations without departing from the essence and gist of the present invention.

What is claimed is:

1. A pressure booster for a pressurized fluid, comprising: a pressure boosting unit; and a bypass unit, wherein:

the pressure boosting unit includes an input port connected to a fluid supply source and an output port connected to a tank, the pressure boosting unit being configured to boost a pressure of a pressurized fluid supplied to the input port and output a pressure-boosted pressurized fluid from the output port;

the bypass unit includes a bypass flow path having one end connected to the fluid supply source and another end connected to the output port, and the bypass flow path is provided with a bypass check valve configured to block flow of the pressure-boosted pressurized fluid from the output port to the fluid supply source;

the pressure boosting unit is configured to have a cylinder structure in which drive cylinders are provided on both sides of a pressure boosting cylinder;

the input port is connected to the fluid supply source via a main flow path provided in the bypass unit;

the bypass flow path is connected to the output port via a merging port provided in the pressure boosting unit;

the bypass unit is attached to a front face of the pressure boosting cylinder, wherein the input port and the merging port are opened in the front face; and the output port is open in a lower surface of the pressure boosting cylinder.

2. The pressure booster according to claim 1, wherein:

the input port is connected to the fluid supply source via a main flow path provided in the bypass unit; and the bypass flow path is configured to branch from the main flow path.

3. The pressure booster according to claim 1, wherein the bypass flow path is connected to the output port via a merging port provided in the pressure boosting unit.

* * * * *